United States Patent [19]

Tyrer et al.

[11] 4,193,153

[45] Mar. 18, 1980

[54] LIFE JACKET

[75] Inventors: Andrew C. R. Tyrer, 144, Rupert Rd., Huyton, Liverpool L36 9TH, England; David G. Lace, Wigan, England

[73] Assignees: R. Perry & Company Limited, Merseyside; Andrew Charles Ratcliffe Tyrer, Liverpool, both of England

[21] Appl. No.: 916,754

[22] Filed: Jun. 19, 1978

[30] Foreign Application Priority Data

Mar. 28, 1978 [GB] United Kingdom ..... 11938/78

[51] Int. Cl.[2] ..... B63C 9/10

[52] U.S. Cl. ..... 9/342; 29/433; 29/445; 156/245; 156/253; 264/321

[58] Field of Search ..... 9/311-312, 9/329-330, 333, 336, 337-339, 340-342; 156/245, 253; 264/321; 29/433, 445

[56] References Cited

U.S. PATENT DOCUMENTS

| | | | |
|---|---|---|---|
| 2,374,580 | 4/1945 | Brown | 9/338 |
| 3,988,795 | 11/1976 | Robertson | 9/340 |

FOREIGN PATENT DOCUMENTS

| | | | |
|---|---|---|---|
| 656610 | 1/1963 | Canada | 9/338 |

*Primary Examiner*—Barry L. Kelmachter
*Assistant Examiner*—Jesus D. Sotelo
*Attorney, Agent, or Firm*—Gipple & Hale

[57] ABSTRACT

A lifejacket is provided comprising a one piece body member of moulded, flexible, plastic foam. The lifejacket is divided into three distinct portions; that is a headrest portion, a shoulder portion and a chest portion, the shoulder portion incorporating a neck aperture. A longitudinal slit is provided which extends through the chest portion from the neck aperture thereby dividing the chest portion into two similar parts. The longitudinal slit facilitates the fitting of the life jacket to a wearer. A one piece tape is provided which passes through two longitudinally spaced transverse bores, one extending through the headrest portion and the other through the chest portion.

19 Claims, 10 Drawing Figures

LIFE JACKET

This invention relates to lifejackets and a method of manufacture thereof and is particularly concerned with lifejackets of the type having a body member of moulded, flexible, closed-cell, plastic foam.

In accordance with the present invention there is provided a life jacket comprising a one piece body member of moulded flexible plastic foam which includes a head-rest portion, a shoulder portion and a chest portion, a neck aperture which is incorporated in the shoulder portion, a longitudinal slit which extends through the chest portion from the neck aperture thereby dividing the chest portion into two similar parts, and a one piece tape, which passes through at least two longitudinally spaced transverse apertures of the lifejacket, for securing it to a wearer.

Advantageously, one of the transverse bores is located in the head rest portion and another is located in the chest portion of the lifejacket, the tape being threaded from a first side of the jacket first through the bore in the chest portion, then through the bore in the head rest portion from the second side of the jacket, then again through the bore in the headrest portion commencing from the second side, whereby a loop is formed above the headrest portion, and then finally through the chest portion commencing from the first side.

Also in accordance with this invention there is provided a method of manufacture of the lifejacket described in the second paragraph of this Specification, which method of manufacture comprises the steps of internally heating sheets of foam and then surface heating said sheets until a thermo laminable state is achieved, said sheets being then assembled in layers in a mould which is open around the outside but closed about an internal rim, so as to form the neck aperture. Subsequent compression of the mould allows thermoforming of the foam to take place until the jacket is cool, whence the jacket is removed from the mould and the tape then threaded through the transverse apertures which are formed by the insertion of bars between the sheets as they are being assembled in the mould.

The invention is further described hereinafter, by way of example only, with reference to the accompanying drawings, in which.

Figure 1:
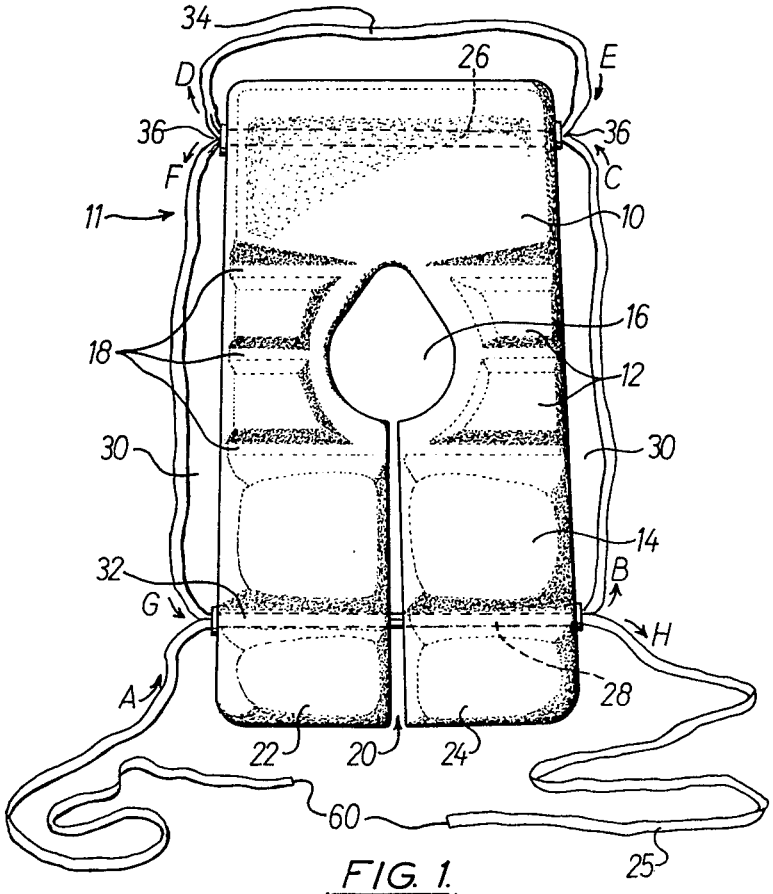
FIG. 1 is a front elevational view of a lifejacket in accordance with the invention.
Figure 6:
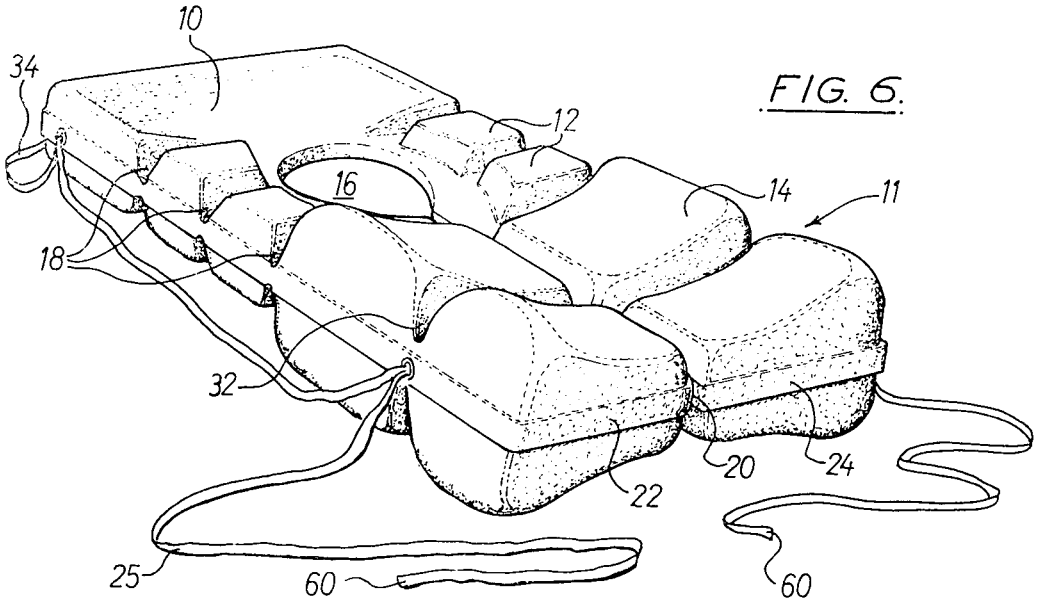
FIG. 6 is a perspective view of the embodiment of FIG. 1.

The lifejacket 11 shown in FIGS. 1 and 6 comprises a head-rest portion 10, a shoulder portion 12 and a chest portion 14. The shoulder portion 12, incorporates a neck aperture 16 through which the head of the wearer (not shown) is positioned. To provide flexibility over the shoulders of the wearer, the life jacket has thinner portions 18, in the shoulder portion 12 which also serve to isolate the three portions 10, 12 and 14 of the lifejacket.

The lifejacket is provided with a longitudinal slit 20, which allows the two halves 22 and 24 of the chest portion 14 to be separated so that sufficient room can be created to allow the head of the wearer to be pushed through the aperture 16 without difficulty and give the wearer increased comfort while the jacket is being worn.

The jacket is tied to the wearer by way of a one piece tape 25 which is threaded through two transverse bores 26,28 which pass through the jacket in the head-rest portion 10 and chest portion 14, respectively. The reference letters A to H, and the associated arrows, indicate the manner by which the tape 25 is threaded through the jacket.

When the life jacket is to be put onto a wearer the two halves 22, 24 of the chest portion 14 are separated, slack being taken up from the loose ends A and H of the tape. When the two halves are sufficiently parted, the head of the wearer is slipped through the neck aperture 16 so that the shoulder portion 12 is resting on the shoulders and the head-rest portion 10 is behind the head.

It is not important for a particular side of the life jacket to be against the chest since this embodiment of the invention is completely reversible. Furthermore, to increase comfort, the chest portions are contoured to suit the normal shape of a wearer as can be seen in the perspective view of this embodiment illustrated in FIG. 6. When the head is positioned in the neck aperture 16, the arms are then placed through the loops 30 of the tape 25 in the regions F to G and C to B. When the lifejacket is subsequently tightened, these loops come under the armpits of the wearer and thus provide a strong support region. To tighten the lifejacket, the loose ends A and H are pulled and passed around the back of the wearer and then to the front of the jacket. A groove 32 is provided to guide the tape in this region. To finally secure the lifejacket, the two ends can either be tied together in a knot or connected by some other means such as a buckle.

In a preferred embodiment of this invention, a locking means 36 is provided in the ends of a rigid cylindrical tube 38, which is inserted into the bore 26 to protect it from damage. The locking means 36 ensure that the tape cannot slip therethrough, so that the region D to E of the tape 25 forms a becket 34 whereby a rescuer may securely grasp the wearer. Furthermore, they are strong enough to ensure that, when the wearer is lifted from the water by a rescuer holding the becket 34, the life jacket material undergoes negligible stress or strain. Rather, the strain is mostly taken up by the tape. Since the tape has to withstand this load, in the preferred embodiment polyester webbing is used which meets the requirements of British Parachute Specification No. GQ/MS/140.

Figure 4:
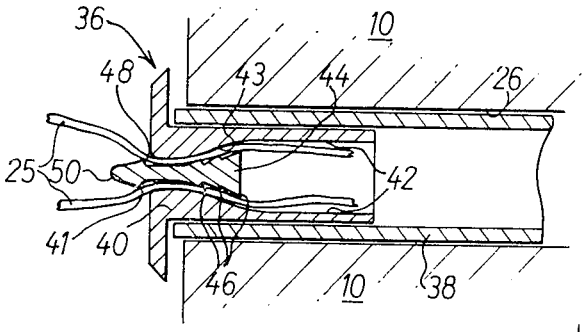
FIG. 4 is a cross section of a tape bushing used in the embodiment of FIG. 1.

The preferred form of locking means 36 is illustrated in FIG. 4 of the accompanying drawings and comprises a flanged bushing 40 positioned in one end of the tube 26. A dart 44 is received within the bushing. These three components 40, 26 and 44 are all preferably constructed from plastic material. Two sections of the tape 25 are to be locked by this mechanism. To accommodate this, the internal bore of the bushing is tapered so that the aperture at the flanged end is narrower than that at the other end. The dart 44 is provided with barbs 46 in the form of frusto-conical extensions of an otherwise substantially cylindrical rod.

After the tape has been threaded through the lifejacket as hereinbefore described, the darts are inserted preferably between two sections of tape in the region between the cylindrical tube 38 and bushing 36. The bushing is then positioned in the tube as shown in FIG. 4 and the tape pulled until the dart comes into the region of tapering internal diameter 43 of the bushing 40. In this region the barbs 46 start to grip the tape preventing its further movement. The tighter the tape is pulled, the stronger the preventive forces become. To prevent the tape slipping back when the tension on it is released (which may allow the dart to free itself entirely from the tape and thereby prevent the further functioning of the locking means) a resilient locking means is provided for maintaining the dart 44 in its locking position. This comprises another frusto-conical barb 48, which is disposed adjacent to an end 50 of the dart and has an external diameter just slightly less than that of the aperture 41. The dimensions and configurations of the barbs 48 and 46 and the internal bore 43 are carefully chosen that, when the barbs 46 are somewhat tightly holding the tape 25 against the internal wall 43, the barb 48 is positioned just beyond the aperture 41. To get the dart into this position is a relatively difficult operation since the combined thickness of the barb 48 and tapes 25 is greater than the internal diameter of the aperture 41. Thus, considerable force has to be exerted. However, once the dart has reached its position it is even more dificult to push it back. This is because the barb 48, while it tended to be closed, thereby reducing its external diameter, in pushing the dart into position, tends to spread as it is attempted to remove the dart thereby increasing the external diameter of the barb 48 and so making the task of removing it all the more difficult.

Figure 5:
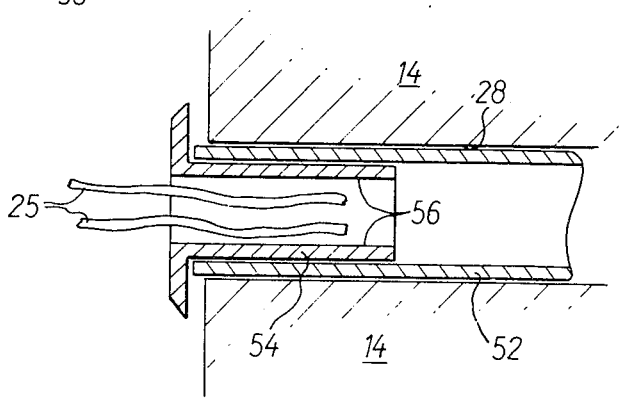
FIG. 5 shows another tape bushing also used in the embodiment of FIG. 1.

As shown in FIG. 5, a second cylindrical tube 52 is provided in the bore 28 through the chest portion 14 of the lifejacket. This tube also protects the foam from damage. However, since locking means are not required, bushings 54, with cylindrical internal bores 56, are supplied to guide to the tape 25. No darts are required.

Alternatively the second cylindrical tube is omitted and the bushings 54 are inserted directly into the ends of the bore 28 through the chest portion of the jacket.

Preferably, the aforegoing lifejacket is constructed from sheets of flexible, closed-cell plastic foam, preferably cross-linked ethylene vinyl acetate. In order to construct the relatively complicated shape of the lifejacket, sheets which are preferably in a de-skinned state and are, for example of the order of 25 to 30 mm thick and conveniently of the order of 25 to 35 mm thick, are cut in the relative numbers and shapes as illustrated in FIG. 3.

Figure 2:
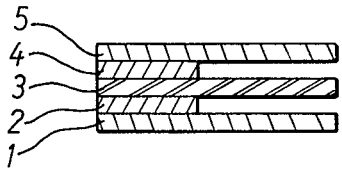
FIG. 2 is a diagrammatic cross sectional side view of a lifejacket in accordance with this invention showing the layerings of the plastics sheets.
Figure 3A:
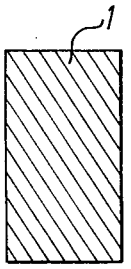
FIGS. 3 (A–E) is a series of diagrammatic plan views of the embodiment of FIG. 2 showing the progressive arrangement of the sheets prior to moulding.
Figure 3B:
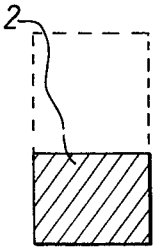
Figure 3C:
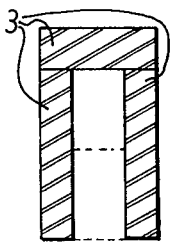
Figure 3D:
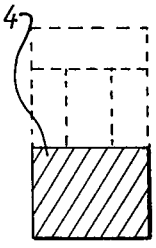
Figure 3E:
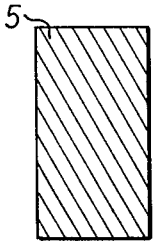

These sheets are then placed in an infra-red oven where the foam is heated internally and then in a hot-air oven where the external surface is heated to a thermo-laminable state. Other techniques of heating are acceptable including sonic heating. The sheets are then placed in one half of a mould (not illustrated) in the manner indicated in FIGS. 2 and 3.

The other half is then placed on top and the material compressed for a period of time which may be of the order of fifteen minutes. The mould is closed about an internal rim around the neck aperture, but around the outside of the lifejacket the mould is left open so as to avoid rupturing of the cells owing to the material being too thick.

Compression of the material allows thermo-forming to take place. When the material has cooled, the jacket is removed from the mould and the chest portion is divided down the middle with excess material being removed. The outside of the jacket is also trimmed off. The bore through the headrest and chest portions are preferably formed during thermoforming, by the insertion of bars between the layers of material before the mould is compressed. The bore 26 is then reinforced by the tube 38, and finally the tapes are inserted in the manner hereinbefore described.

In order to prevent the tape ends from fraying, and also to prevent the tape being accidently dethreaded from the lifejacket, the tape has stops 60, preferably of plastic material, attached to its ends. These stops are too large to pass through the bore 28 and, moreover, would normally be brightly colored in order that the location of the tape ends might be facilitated.

From the above described method of manufacture it will be appreciated that an advantage of the aforegoing lifejacket is that no sewing is necessary in order to attach the tapes and so the danger of threads rotting or not being sewn properly is avoided.

We claim:

1. A lifejacket comprising a one-piece body member of moulded, flexible, plastic foam which includes a shoulder portion coupled to a headrest portion and to a chest portion so that when the lifejacket is in its initial unstressed state, the headrest, shoulder and chest portions are substantially coplanar, said shoulder portion defining a neck aperture, said chest portion defining a longitudinal slit which extends through from said neck aperture thereby dividing the chest portion into two similar parts, means defining a transverse bore through said headrest portion and a transverse bore through said chest portion and a one-piece tape having two free ends which pass through said transverse bores for securing the lifejacket to a wearer, the tape being threaded from a first side of the body member through said second bore in the chest portion, then through a first bore in the headrest portion from the other side of the body member, then again through said second bore in the chest portion from the first side of the member so that said two free ends of the tape extend from opposite ends of said second bore, respectively.

2. A lifejacket comprising a one-piece body member of moulded, flexible, plastic foam which includes a shoulder portion coupled to a headrest portion and to a chest portion means defining a neck aperture in the shoulder portion, means defining a longitudinal slit which extends through the chest portion from said neck aperture thereby dividing the chest portion into two similar parts, means defining a first transverse bore through said headrest portion, a rigid cylindrical tube means positioned in said bore in the headrest portion, means defining a second transverse bore through said chest portion, a one-piece tape having two free ends which pass through said transverse bores for securing the lifejacket to a wearer, and a tape locking means in said tube means in the headrest portion for rigidly locking the tape relative to said headrest portion bore, the tape being threaded through said body member to form a loop above the headrest portion, with said two free ends of the tape extending from opposite ends of said second bore.

3. A lifejacket comprising a one-piece body member of moulded, flexible, plastic foam which includes a shoulder portion coupled to headrest portion and to a chest portion so that, when the lifejacket is in its initial unstressed state, the headrest, shoulder and chest portions are substantially coplanar, said shoulder portion defining a neck aperture and said chest portion defining a longitudinal slit which extends through the chest portion from said neck aperture thereby dividing the chest portion into two similar parts, the chest portion being of generally concave profile for matching the normal shape of a wearer and the external shape of the lifejacket being symmetrical about a central longitudinal plane allowing a wearer's head to be inserted through the neck hole from either direction, means defining first transverse bore through said headrest portion, means defining a second transverse bore through said chest portion, and a one-piece tape having two free ends which pass through said transverse bores for securing the lifejacket to a wearer, the tape being threaded from a first side of the body member initially through said second bore in the chest portion, then through said first bore in the headrest portion from the other side of the jacket, then again through said second bore in the chest portion from the first side of the body member so that said two free ends of the tape extend from opposite ends of said second bore.

4. A one-piece lifejacket body member of moulded, flexible, plastic foam comprising a shoulder portion coupled to a headrest portion and to a chest portion such that, when the lifejacket is in its initial unstressed state, the headrest, shoulder and chest portions are substantially coplanar, means defining a neck aperture in the shoulder portion, means defining a longitudinal slit which extends through the chest portion from said neck aperture thereby dividing the chest portion into two similar parts, means defining a first transverse bore through said headrest portion, means defining a second transverse bore through said chest portion, and a one-piece tape means having two free ends which pass through said transverse bores for securing the lifejacket to a wearer, the tape means being threaded from a first side of the body member initially through said second bore in the chest portion, then through said first bore in the headrest portion from the second side of the body member, then again through said first bore in the headrest portion commencing from the second side of the body member forming a loop above the headrest portion, and then finally through the chest portion from the first side of the body member, so that said two free ends of the tape means extend from opposite ends of second bore, respectively.

5. A lifejacket according to claim 4 including a locking means by which the tape is locked in said bore through the headrest portion whereby the loop formed above the head rest portion constitutes a becket of predetermined length.

6. A lifejacket according to claim 5 in which the sole means by which said one piece tape is secured to the lifejacket is by said locking means.

7. A lifejacket according to claim 5 in which the locking means is provided in bushings disposed in the ends of the transverse bore in the headrest portion.

8. A lifejacket according to claim 7 in which said bushings have a tapering bore and said locking means comprises a dart which is adapted to be received within said bushing and which is provided with gripping means for gripping the tape between said dart and said bushing.

9. A lifejacket according to claim 8 in which said dart comprises a substantially cylindrical section and in which said gripping means comprises at least one first barb disposed on said dart.

10. A lifejacket according to claim 9, in which there is provided a plurality of barbs arranged along said dart, said barbs having such dimensions that the diameters of said dart in the region of each barb vary in conformity with said tapering of the bore of said bushing such that, when said dart is in its operational position in said bushing, the radial separation between each of said barb and said internal bore is substantially constant.

11. A lifejacket according to claim 9 in which said dart comprises a second barb of such size that the greatest diameter of the dart in the region of said second barb is less than the internal diameter of the bore of said bushing, said first and second barbs being longitudinally spaced on said dart so that, when said first barb is in its operational position in said bushing, in which position it locks the tapes therein, said second barb extends beyond one end of the bushing and has an external diameter of such dimensions that the combined thickness of said dart and said tapes in the region of said second barb is greater than the internal diameter of the bore of the bushing at said one end, a snap-fit type action being required in order to place the dart in said operational position.

12. A lifejacket according to claim 11, in which each barb is in the form of a frusto conical extension of the dart.

13. A lifejacket according to claim 12 in which said bushing is flanged at said one end, said flange being constructed so as to abut the end of a rigid cylindrical tube disposed in said transverse bore through said headrest portion.

14. A lifejacket according to claim 4 in which the side of the jacket remote from the wearer is provided with at least one transverse groove for accommodating the tape means when the lifejacket is being tied to the wearer.

15. A method of manufacturing a lifejacket, which comprises a one piece body member of moulded, flexible, plastics foam which includes a shoulder portion coupled to a headrest portion and to a chest portion, means defining a neck aperture in the shoulder portion, means defining a longitudinal slit which extends through the chest portion from said neck aperture thereby dividing the chest portion into two similar parts, means defining at least two longitudinally spaced transverse bores in said headrest and chest portions, and a one piece tape which passes through said at least two longitudinally spaced transverse bores for securing the lifejacket to a wearer, said method comprising the steps of heating sheets of foam until a thermo laminable state is achieved, assembling said sheets in layers in a mould which is open around the outside but closed about an internal rim, whereby said neck aperture can be formed, subsequent compression of said mould allowing thermoforming of the foam to take place until the jacket is cool, forming said transverse bores through the jacket and then threading said tape therethrough.

16. A method according to claim 15 in which at least one of said bores is formed by the insertion of a bar between said sheets before compression of the mould.

17. A method as claimed in claim 15 or 16 in which at least one of said bores is formed by drilling through the jacket after removal thereof from said mould.

18. A method as claimed in claim 15 further comprising the steps of removing said jacket from the mould when thermo-forming is completed, and dividing said jacket longitudinally from the neck aperture to the base of the jacket, the edges of the jacket being trimmed.

19. A method according to claim 15, in which said sheets, which are assembled in layers in the mould, comprise a first sheet which covers the base of the mould, a second sheet which is near the base of the mould, a middle layer of sheets comprising two side pieces which extend the length of the mould and a transverse piece at the top of the mould, a third sheet positioned as the second sheet and a fourth sheet positioned as the first, said sheets being so arranged as to form the shape of the lifejacket.

* * * * *